United States Patent [19]

Green, II

[11] Patent Number: 4,577,583

[45] Date of Patent: Mar. 25, 1986

[54] SMALL GLIDING UNDERWATER CRAFT

[76] Inventor: John G. Green, II, 9041 SW. 156th St., Apt. B-5, Miami, Fla. 33157

[21] Appl. No.: 625,799

[22] Filed: Jun. 28, 1984

[51] Int. Cl.[4] ..... B63G 8/00

[52] U.S. Cl. ..... 114/332; 114/330

[58] Field of Search ..... 440/13, 68; 114/312, 114/330–334, 337, 274, 280, 281, 162, 163, 170, 171, 282

[56] References Cited

U.S. PATENT DOCUMENTS

| | | | |
|---|---|---|---|
| 1,223,616 | 4/1917 | Riecks | 440/58 |
| 1,256,246 | 2/1918 | Nagel | 440/68 |
| 2,011,618 | 8/1935 | Dawson | 114/163 |
| 2,691,497 | 10/1954 | Scheider | 114/163 |
| 2,849,978 | 9/1958 | Durham | 114/163 |
| 2,929,346 | 3/1960 | Perce | 114/284 |
| 3,082,975 | 3/1963 | Cardwell | 244/2 |
| 3,157,145 | 11/1964 | Ferris | 114/332 |
| 3,650,234 | 3/1972 | Goudy | 114/332 |
| 3,943,869 | 3/1976 | Prechette | 114/330 |
| 4,080,922 | 3/1978 | Brubauer | 114/282 |

*Primary Examiner*—Trygve M. Blix
*Assistant Examiner*—C. T. Bartz
*Attorney, Agent, or Firm*—Harvey B. Jacobson

[57] ABSTRACT

An elongated streamlined hull is provided having front and rear ends and a first pair of rear opposite side horizontally outwardly projecting main foils are supported from the hull and have their centers of plan area disposed aft of amidships of the hull. A second pair of forward foils of considerably smaller plan area are mounted from opposite side forward portions of the hull spaced considerably forward of amidships for controlled angular displacement relative to the hull about generally horizontal axes extending transversely of the hull. First control structure is provided for simultaneously adjustably angularly displacing the forward foils and the hull includes front and rear buoyancy tanks, a compressed gas storage tank disposed centrally intermediate the buoyancy tanks and second control structure operatively associated with the storage and buoyancy tanks to selectively flood and blow the buoyancy tanks with ambient water and compressed gas from the storage tank. The rear of the hull includes angularly displaceable upstanding rudder structure and a rear lower portion of the hull defines a rearwardly opening recess in which an electric motor driven rearwardly discharging marine propeller equipped propulsion assembly is mounted for adjustable angular displacement about an upstanding axis. Third control structure is provided for simultaneously angularly displacing the rudder structure and the propulsion assembly and opposite side rear lower portions of the hull include water ingress passages opening outwardly of opposite sides of the hull and inwardly into the inner portion of the aforementioned recess.

9 Claims, 11 Drawing Figures

FIG. 2
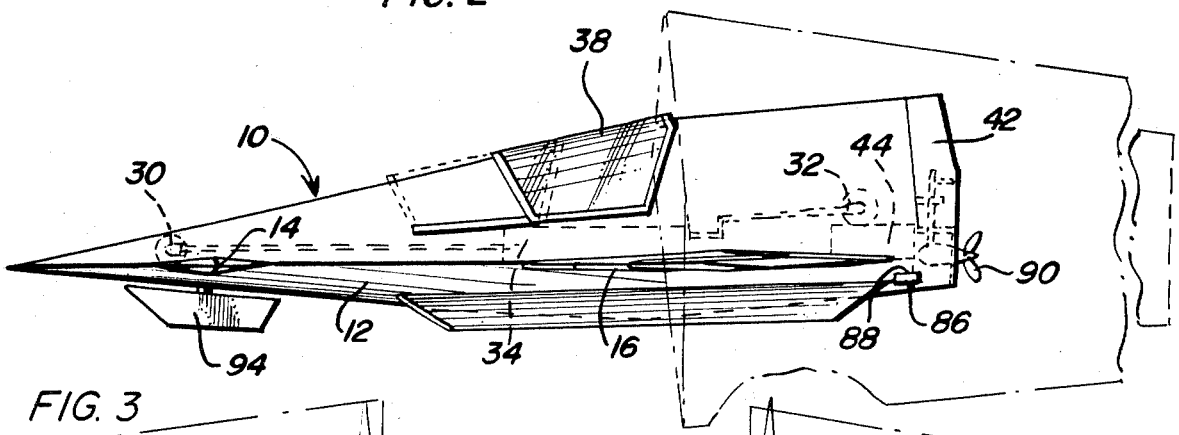
FIG. 3
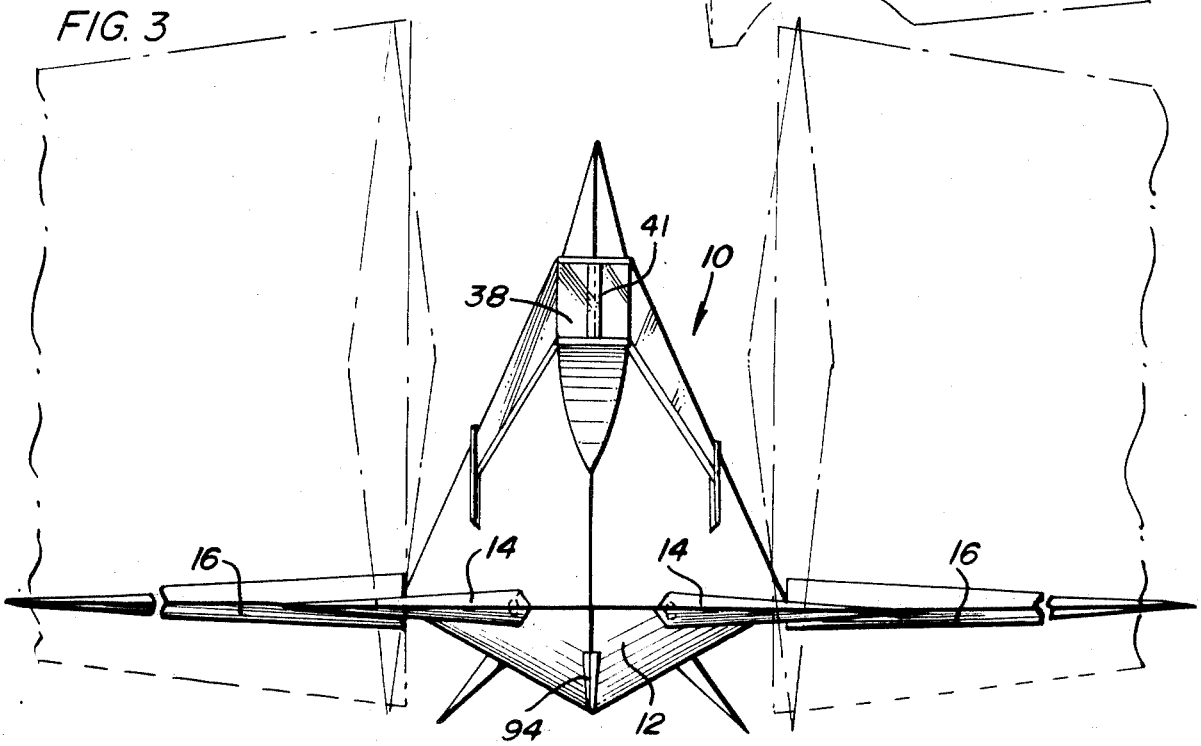
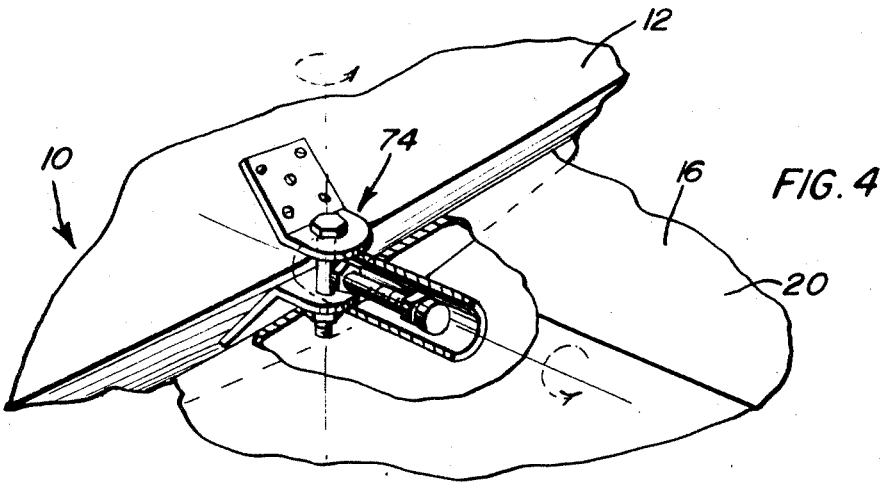
FIG. 4

SMALL GLIDING UNDERWATER CRAFT

BACKGROUND OF THE INVENTION

Underwater sport and exploration craft heretofore have been provided but most of these underwater craft are reliant upon either manually or motor driven propulsion means. The operation of manually driven propulsion means is of course very tiring to a person using the underwater craft and the utilization of motor driven propulsion means conventionally incorporates an electric motor and thus requires heavy large capacity batteries if the underwater craft is to be used for other than very short distances.

In addition to powered underwater craft various forms of motorless underwater hydrodynamic gliders heretofore have been provided such as that disclosed in U.S. Pat. No. 3,157,145. However, vertical and horizontal direction of movement control of such underwater gliders has been at best marginal and unsuited for manned underwater usage. Accordingly, a need exists for an underwater glider which may be used for sport and recreational purposes with safety of the operator and precise horizontal and vertical directional control of the glider being achieved to a high degree.

Various forms of vehicles other than underwater gliders and which incorporate some of the general structural and operational features of the instant invention are disclosed in U.S. Pat. Nos. 1,223,616, 1,250,987, 2,849,978, 2,929,346, 3,082,975, and 3,943,869.

BRIEF DESCRIPTION OF THE INVENTION

The underwater craft of the instant invention is constructed in the form of a hydrodynamic glider having greater than a 15 to one glide ratio, either positive or negative.

The craft is provided with front and rear ballast tanks which may be selectively flooded and blown and a central compressed gas tank to be used in blowing the front and rear buoyancy tanks. A minimum volume of compressed gas is required to blow the relatively small volume front and rear buoyancy tanks and, with a minimum supply of compressed gas in the supply tank perhaps 20 or more successive negative and positive glide paths may be carried out. If the operator of the craft is equipped for depths up to 100 feet, the craft may therefore travel a distance of approximately 6,000 feet or over 11 miles solely by alternating between negative and positive buoyancy operating conditions.

The craft, however, is provided with a storage battery carried within a flooded compartment of the craft and an electric motor driven marine propulsion assembly capable of receiving power from the storage battery. The marine propulsion assembly is mounted within a rearwardly opening recess at the rear of the hull and controllably oscillatable about a vertical axis. The hull furthere includes opposite side water ingress passages opening laterally outwardly of opposite sides of the hull and inwardly into the inner closed end of the aforementioned recess. Lightly spring-biased doors may close the outer ends of the water ingress passageways and automatically open to allow the ingress of water therethrough upon operation of the marine propulsion assembly.

Further, the craft includes rudder structure oscillatable about a vertcal axis and supported from the rear of the hull above the marine propulsion assembly. The marine propulsion assembly is operatively connected with the rudder structure for simultaneous operation thereof responsive to oscillation of the marine propulsion assembly. Still further, the hull includes an operator's cockpit including a transparent downwardly opening canopy into which gas being exhausted from the operator's underwater breathing apparatus may be received and trapped in case of an emergency in order to increase positive buoyance of the craft, the canopy being provided with manually operable vent structure for venting gas from therebeneath.

The main object of this invention is to provide a lightweight, readily transportable and dependable underwater craft which may be used for underwater sport use and exploration over extended periods of time by an operator provided with his own underwater breathing apparatus and with the craft being capable of reasonably long distance operation independent of manual or motor driven marine propulsion structure.

Another object of this invention is to provide an underwater craft in accordance with the preceding objects including opposite side front and rear small and large foils and front and rear buoyancy tanks which may be selectively flooded and blown in order to enable the craft to glide under water along alternately oppositely inclined paths merely by selective flooding and blowing of the buoyancy tanks thereof.

Yet another object of this invention is to provide an underwater craft also equipped with a minimal use electrically driven marine propulsion assembly for use in emergencies.

A further object of this invention is to provide an underwater craft constructed in a manner whereby its positive buoyancy may be appreciably increased by the trapping of breathing air being exhausted by the operator of the craft from an underwater breathing apparatus.

A further important object of this invention is to provide an underwater craft which will be capable of extended underwater operation over reasonably great distances and yet which will be lightweight and readily trailerable from one location to another.

A final object of this invention to be specifically enumerated herein is to provide an underwater craft in accordance with the preceding objects and which will conform to conventional forms of manufacture, be of simple construction and easy to use so as to provide a device that will be economically feasible, long lasting and relatively trouble free in oeration.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a side elevational view of the assemblage illustrated in FIG. 1;

FIG. 3 is a fragmentary enlarged front elevational view of the underwater craft;

FIG. 4 is a fragmentary perspective view illustrating one of the hinge assemblies by which one of the main foils of the underwater craft is mounted for compound hinging toward a folded transit position;

DETAILED DESCRIPTION OF THE INVENTION

Figure 1:
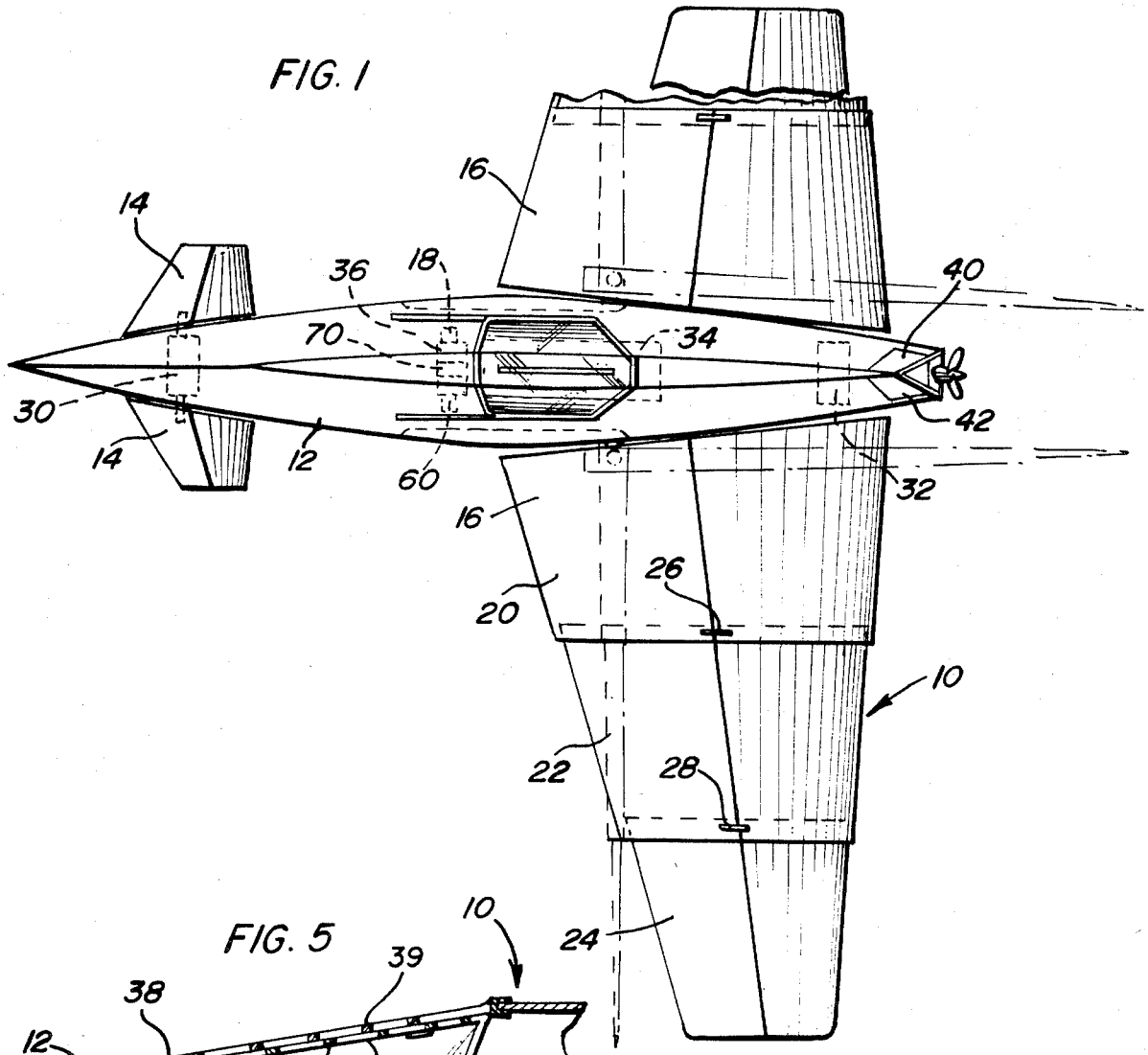
FIG. 1 is a top plan view of the underwater craft with folded positions of the main foils thereof illustrated in phantom lines.
Figure 5:
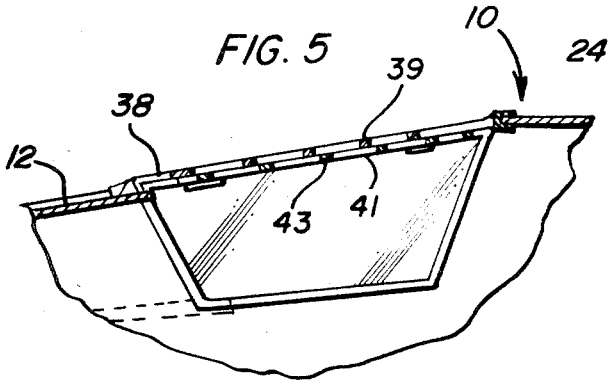
FIG. 5 is an enlarged fragmentary longitudinal vertical sectional view illustrating the transparent canopy of the underwater craft and the slide panel supported therefrom by which gases trapped within the canopy may be vented therefrom.

Referring now more specifically to the drawings, the gliding underwater craft of the instant invention is referred to in general by the reference numeral 10 and includes a streamlined main fuselage or hull 12, a pair of forward opposite side neutral lift small foils 14 and a pair of rear opposite side neutral lift main foils 16. The small forward foils 14 are mounted for angular displacement, in unison, about a horizontal transverse axis extending therebetween in any convenient manner (not shown). Further, the interior of the fuselage 12 includes a control 18 whereby the foils 14 may be adjustably angularly displaced as desired.

Each of the main foils 16 includes three relatively telescopingly supported sections 20, 22 and 24 and suitable latch structure 26 is provided for releasably retaining the section 22 in extended position relative to the section 20 while similar latch structure 28 is provided for releasably retaining the section 24 in extended position relative to the section 22.

The front and rear interior portions of the fuselage 12 include ballast tanks 30 and 32 and the longitudinal center portion of the interior of the fuselage 12 includes a large capacity compressed gas tank 34. The tanks 30 and 32 may be selectively flooded from the ambient water of "blown" free of water by compressed gas from the tank 34. The suitable control 36 is provided and may be utilized to selectively flood and "blow" the tanks 30 and 32. The control 36 may be of any suitable well known type.

The controls 18 and 36 are contained within a cockpit area within the hull 12 and the upper portion of the cockpit area is closed by a sliding canopy 38 having gas outlet or escape openings 39 formed therethrough. However, the underside of the upper wall of the canopy 38 includes a valve plate 41 slidably supported therefrom and including openings 43. The valve plate 41 may be shifted between positions with the openings 43 in and out of registry with the openings 39 and the operator of the craft 10 is to be positioned immediately beneath the canopy 38.

When the craft 10 is operated below the surface of a body of water the interior of the hull 12 is flooded and the operator utilizes underwater breathing apparatus. In this manner, precise control of neutral buoyancy of the craft 10 is achieved. During operation of the craft the openings 43 are registered with the openings 39 in order to allow gases exhaled by the operator to escape from beneath the canopy 38. However, in the event of an emergency, the valve plate 41 may be shifted to a position with the openings 43 out of registry with the openings 39. In this manner, the gas exhaled by the operator of the craft 10 will be trapped beneath the canopy and gradually displace some of the water within the hull 12 to thereby increase the buoyancy of the craft 10 and allow it to rise to the surface independent of other operating conditions. Further, the control 36 is also operative to selectively vent compressed gas from the tank 34 into the area beneath the canopy 38.

Figure 6:
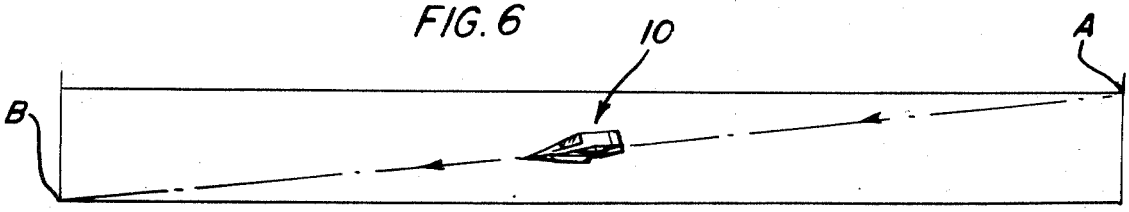
FIG. 6 is a diminished side elevational view of the underwater craft illustrating the manner in which it may move along a downwardly inclined path as a result of negative buoyancy of the underwater craft.

Assuming that the craft 10 is disposed at point A in FIG. 6 and the operator of the craft 10 wishes to proceed forwardly and to descend slightly to point B in FIG. 6, the forward tank 30 is slightly flooded and the small foils 14 are angled slightly forwardly and downwardly. The slight flooding of the tank 39 will establish negative buoyancy at the forward end of the hull 12 and the foils 14 and 16 will cause the underwater craft 10 to glide downwardly and forwardly through the water from point A to point B. After initial downward gliding of the craft 10 has been accomplished from point A, the small foils 14 may be returned to their neutral positions and forward downward gliding of the craft 10 will continue.

If, after reaching point B the operator of the craft 10 wishes to continue movement forward but he does not wish to increase the depth of the craft 10, the forward tank 30 may be blown substantially completely in order to establish positive buoyancy at the forward end of the hull 12 while at the same time the small foils 14 may be angularly displaced to slightly forwardly and upwardly inclined positions. This of course will cause the craft 10 to continue forward, but in an upwardly inclined direction.

If the rear of the hull 12 has neutral buoyancy downward and upward gliding of the craft 10 may be effected by flooding and blowing the forward tank 30, only. However, in some instances it will also be necessary to flood and blow the rear tank 32.

The rear of the hull 12 tapers rearwardly to its rear extremity and at the rear extremity of the hull the opposite side surfaces thereof are spaced apart. The rear opposite side portions of the hull 12 include rudder flaps 40 and 42 pivotally mounted along their forward upstanding marginal edge portions from the remainder of the hull 12 and selectively swingable to rearward and outward inclined positions.

Mounted within the rear of the hull 12 is a marine propulsion unit 44 and the propulsion unit 44 includes a watertight housing 46 in which a watertight battery box 48 is contained. The rear of the housing 46 includes a pair of vertically spaced mounts 50 from which a vertical support shaft is oscillatably supported. The upper end of the support shaft 52 includes a rearwardly projecting abutment arm 54 and a laterally projecting control arm 56 to which one end of a suitable steering cable assembly 58 is connected. The other end of the steering cable assembly is connected to a suitable control 60 for actuation by the operator of the craft 10. The lower end of the shaft 52 supports a screw propeller equipped and electric motor actuated marine propulsion head 62 and the head 62 is operatively connected to a battery 64 within the battery box 48 by a waterproof electrical conductor assembly 66. The conductor assembly 66 also being under the control of a control 70 for actuation by the operator of the craft 10. In addition, the rudder flaps 40 and 42 are spring-biased toward closed positions co-extensive with adjacent corresponding side portions of the hull 12, but the inner surfaces thereof are engageable by the free rear end of the abutment arm 54. Accordingly, if the support shaft 52 is angularly displaced by the control cable 58 to execute a turn to the right during operation of the head 62, the free end of the abutment arm 54 will engage and outwardly displace the rear end of the rudder flap 40 to assist in making a turn to the right. Of course, a turn to the left may be made in a similar manner.

On the other hand, if it is desired to proceed forwardly at a constant depth, neutral buoyancy of the front and rear ends of the hull 12 may be accomplished and the control 70 may be operated to actuate the marine propulsion head 62 and lateral steering of the craft 10 may be accomplished by the control 60, the latter being operative to control the direction of thrust developed by the head 62 and also the rudder fins 40 and 42.

Figure 11:
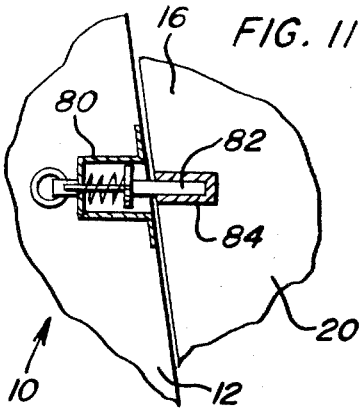
FIG. 11 is a fragmentary horizontal sectional view illustrating the releasable latch structure provided for releasably latching the main foils of the underwater craft in extended operative positions.

With attention now invited more specifically to FIGS. 4 and 11 of the drawings, it may be seen that each of the main foils 16 is supported from the hull 12 through the utilization of a double axis hinge assembly referred to in general by the reference numeral 74. Accordingly, the main foils 16 may be hingedly collapsed from the solid line positions thereof illustrated in FIGS. 1 and 2 to the phantom line positions illustrated in FIGS. 1 and 2. Further, each of the main foils 16 may be longitudinally collapsed in the manner previously described through the telescopic connections of the sections 22, 24 and 26 thereof illustrated in FIG. 1.

Figure 7:
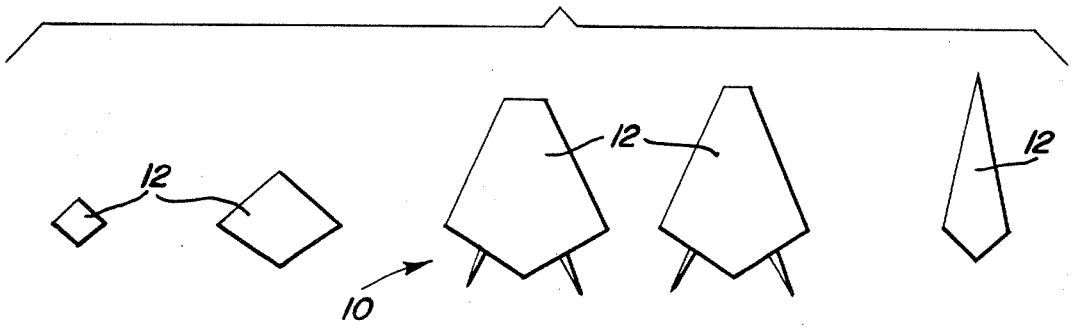
FIG. 7 is a grouping of schematic transverse sectional views illustrating successive longitudinally spaced transverse sectional shapes of the underwater craft.
Figure 8:
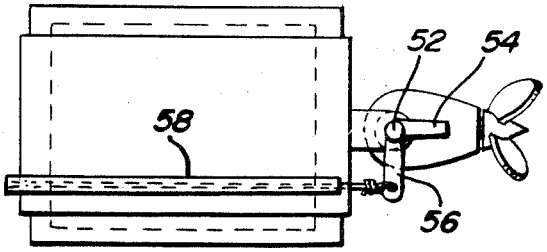
FIG. 8 is a top plan view of the battery powered marine propulsion unit of the underwater craft fragmentarily illustrating the operating control for variable directional thrust thereof.
Figure 9:
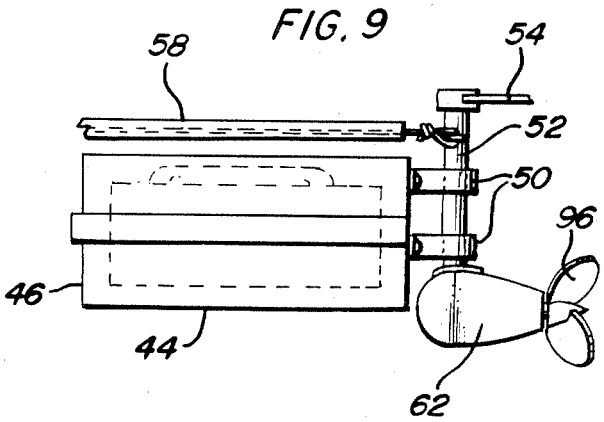
FIG. 9 is a side elevational view of the assemblage illustrated in FIG. 8 and illustrating the rudder actuating upper arm portion of the oscillatable assembly of the marine propulsion unit.
Figure 10:
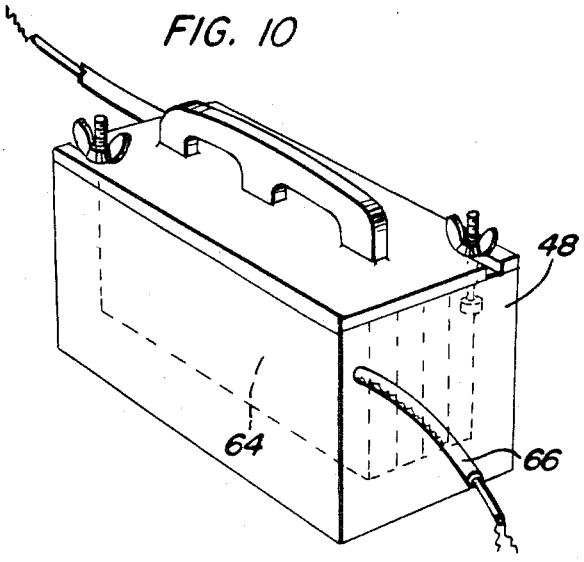
FIG. 10 is a perspective view of the sealed storage battery containing case of the marine propulsion unit.

From FIG. 7 of the drawings it will be noted that various longitudinally spaced portions of the hull 12 include upper opposite side surfaces which are inwardly and upwardly inclined and lower opposite side surfaces which are downwardly and inwardly inclined. In this manner, directional stability of the hull 12 is increased and the hull 12 is substantially immediately laterally deflected by cross currents with minimum water current turbulence on the downstream side of the hull 12. Accordingly, the relatively low coefficient of water friction on the hull 12 is maintained at a minimum, even when the hull 12 is subject to sudden lateral currents. Further, the hull 12 is almost immediately responsive to lateral currents to the extent that the operator of the craft 10 may be aware, by feel, when lateral currents are encountered. In this manner, the operator of the craft 10 may make steering adjustments to compensate for lateral currents.

With attention now invited more specifically to FIG. 11 of the drawings, when the foils 16 are swung to their operative positions illustrated in solid lines in FIGS. 1 and 3 of the drawings, they may be latched in those operative positions by latch structures 80 releasable from within the fuselage 12 and including spring-biased latchpins 82 receivable within keeper sockets 84 mounted within the sections 20 of the foils 16.

Also, it will be noted that the marine propulsion unit 44 is mounted within a rearwardly opening recess formed in the lower portion of the rear of the hull 12 and that the head 62 is embraced within that recess and projects rearwardly therefrom. Further, opposite side rear lower portions of the hull 12 include water inlet openings 86 removably closed by spring-biased inwardly swingable closure flaps 88. The openings 86 open into the recess in which the unit 44 is disposed and operation of the head 62 creates a negative pressure within the recess sufficient to inwardly open the flaps 88, whereby water may be admitted into the recess containing the unit 44 for rearward movement toward and action upon by the marine propeller 90 of the head 62.

Also, the forward underside portion of the hull 12 includes a dependingly supported rudder 94 mounted for oscillation relative to the hull 12 about an upstanding axis. The rudder 94 is mounted on a pivot shaft operably connected to the control 60 for inverse angular displacement relative to the support shaft 52, the rudder 94 and propulsion head 62 tending to steer the bow and stern ends of the hull 12 in opposite lateral directions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A gliding underwater craft including an elongated streamlined hull having front and rear ends, a first pair of rear opposite side horizontally outwardly projecting foils having their centers of plan area disposed aft of amidships of said hull, a second pair of forward opposite side horizontally outwardly projecting foils considerably smaller in plan area than said first pair of foils and mounted from opposite side forward portions of said hull spaced considerably forward of amidships for controlled angular displacement relative to said hull about generally horizontal axes extending transversely of said hull, first control means for simultaneously angularly displacing said forward foils about said axes, said hull including front and rear buoyancy tank means, compressed gas storage tank means mounted within said hull centrally intermediate said buoyancy tank means, and second control means operatively associated with said storage and buoyancy tank means for selectively flooding and blowing said buoyancy tank means with ambient water and compressed gas from said storage tank, a rear lower portion of said hull defining a closed sided, horizontally rearwardly opening recess in which an electric motor driven rearwardly discharging marine propeller equipped propulsion assembly is mounted for adjustable angular displacement about an upstanding axis, third control means operatively connected between said hull and propulsion assembly for angularly displacing the latter relative to said hull, opposite side rear lower portions of said hull including water ingress passages formed therein opening outwardly of opposite sides of said hull and opening inwardly into the inner portion of said recess, said outwardly opening portions of said passages including lightly spring biased closed inwardly swingably openable closure doors.

2. The underwater craft of claim 1 including angularly displaceable upstanding rudder means pivotally supported from the rear end of said hull, said third control means being operatively connected with said rudder means for adjustably angularly displacing said rudder means in unison with said propulsion assembly.

3. The underwater craft of claim 1 wherein the opposite side surfaces of said hull include upper portions thereof which are upwardly convergent and lower portions thereof which are downwardly convergent.

4. The underwater craft of claim 3 wherein said upwardly convergent upper portions of said opposite side hull surfaces define an included angle which gradually diminishes from amidships toward the rear end of said hull.

5. A gliding underwater craft including an elongated streamlined hull having front and rear ends, a first pair of rear opposite side horizontally outwardly projecting foils having their centers of plan area disposed aft of amidships of said hull, a second pair of forward opposite side horizontally outwardly projecting foils considerably smaller in plan area than said first pair of foils and mounted from opposite side forward portions of said hull spaced considerably forward their centers of plan area disposed aft of amidships of said hull, a second pair of forward opposite side horizontally outwardly projecting foils considerably smaller in plan area than said first pair of foils and mounted from opposite side forward portions of said hull spaced considerably forward of amidships for controlled angular displacement relative to said hull about generally horizontal axes extending transversely of said hull, first control means for simultaneously angularly displacing said forward foils about said axes, said hull including front and rear buoyancy tank means, compressed gas storage tank means mounted within said hull centrally intermediate said buoyancy tank means, and second control means operatively associated with said storage and buoyancy tank means for selectively flooding and blowing said buoyancy tank means with ambient water and compressed gas from said storage tank, a rear lower portion of said hull defining a closed sided, horizontally rearwardly opening recess in which an electric motor driven rearwardly discharging marine propeller equipped propulsion assembly is mounted for adjustable angular displacement about an upstanding axis, third control means operatively connected between said hull and propulsion assembly for angularly displacing the latter relative to said hull, opposite side rear lower portions of said hull including water ingress passages formed therein opening outwardly of opposite sides of said hull and opening inwardly into the inner portion of said recess, angularly displaceable upstanding rudder means pivotally supported from the rear end of said hull, said third control means being operatively connected with said rudder means for adjustably angularly displacing said rudder means in unison with said propulsion assembly, said rudder means including opposite side rudder fins mounted from the rear opposite side portions of said hull and swingable between inwardly retracted positions substantially co-extensive with adjacent side surfaces of said hull and rearwardly and outwardly inclined deployed positions, said propulsion assembly including an upstanding support standard mounted for oscillation about its center axis, an upper portion of said support standard including a rearwardly projecting abutment arm closely received between the rear extremities of said rudder fins and selectively engageable with said rudder fins to outwardly deflect the rear ends thereof responsive to oscillation of said standard.

6. A gliding underwater craft including an elongated streamlined hull having front and rear ends, a first pair of rear opposite side horizontally outwardly projecting foils having their centers of plan area disposed aft of amidships of said hull, a second pair of forward opposite side horizontally outwardly projecting foils considerably smaller in plan area than said first pair of foils and mounted from opposite side forward portions of said hull spaced considerably forward of amidships for controlled angular displacement relative to said hull about generally horizontal axes extending transversely of said hull, first control means for simultaneously angularly displacing said forward foils about said axes, said hull including front and rear buoyancy tank means, compressed gas storage tank means mounted within said hull centrally intermediate said buoyancy tank means, and second control means operatively associated with said storage and buoyancy tank means for selectively flooding and blowing said buoyancy tank means with ambient water and compressed gas from said storage tank, angularly displaceable upstanding rubber means pivotally supported from the rear end of said hull, and third control means operatively connected with said rudder means for anjustably angularly displacing said rudder means, and second forward rudder means oscillatably mounted beneath a forward portion of said hull and operatively connected to said third control means for inverse oscillation relative to the first mentioned rudder means.

7. A gliding underwater craft including an elongated streamlined hull having front and rear ends, a first pair of rear opposite side horizontally outwardly projecting foils having their centers of plan area disposed aft of amidships of said hull, a second pair of forward opposite side horizontally outwardly projecting foils considerably smaller in plan area than said first pair of foils and mounted from opposite side forward portions of said hull spaced considerably forward of amidships for controlled angular displacement relative to said hull about generally horizontal axes extending transversely of said hull, first control means for simultaneously angularly displacing said forward foils about said axes, said hull including front and rear buoyancy tank means, compressed gas storage tank means mounted within said hull centrally intermediate said buoyancy tank means, and second control means operatively associated with said storage and buoyancy tank means for selectively flooding and blowing said buoyancy tank means with ambient water and compressed gas from said storage tank, said first pair of foils being each supported from the corresponding side of said hull through the utilization of double axis hinge assemblies for initial 90° angular displacement about horizontal axes extending transversely of said hull and subsequent swinging of said first pair of foils about upstanding axes spaced slightly outward of the corresponding sides of said hull, whereby said first pair of foils may be first swung to upstanding positions and then have their free ends swung rearwarly toward each other into positions with said first pair of foils substantially paralleling said hull, each of said first pair of foils including a plurality of relatively telescopingly engaged foil sections including at least a base end section and an outer end section and with each outer end section being telescopingly receivable within the corresponding base end section.

8. A gliding underwater craft including an elongated streamlined hull having front and rear ends, a first pair of rear opposite side horizontally outwardly projecting foils having their centers of plan area disposed aft of amidships of said hull, a second pair of forward opposite side horizontally outwardly projecting foils considerably smaller in plan area than said first pair of foils and mounted from opposite side forward portions of said hull spaced considerably forward of amidships for controlled angular displacement relative to said hull about generally horizontal axes extending transversely of said hull, first control means for simultaneously angularly displacing said forward foils about said axes, said hull including front and rear buoyancy tank means, compressed gas storage tank means mounted within said hull centrally intermediate said buoyancy tank means, second control means operatively associated with said storage and buoyancy tank means for selectively flooding and blowing said buoyancy tank means with ambient water and compressed gas from said storage tank, said hull including an operator's cockpit with a downwardly opening canopy disposed thereover, said canopy being mounted from said hull for longitudinal shifting along said hull between a first position vertically registered with said cockpit and an second position out of vertical registry with said cockpit, said canopy including an upper portion provided with gas outlet openings therein, and valve means shiftably supported from said upper portion for selectively opening and closing said gas outlet openings.

9. The underwater craft of claim 8 including fourth control means operative to selectively vent compressed gas from said storage tank to the area enclosed beneath said canopy when said canopy is vertically registered with said cockpit.

* * * * *